US007314694B2

(12) United States Patent
Tong et al.

(10) Patent No.: US 7,314,694 B2
(45) **Date of Patent: *Jan. 1, 2008**

(54) PHOTOCONDUCTIVE IMAGING MEMBERS

(75) Inventors: Yuhua Tong, Webster, NY (US); Nancy L. Belknap, Rochester, NY (US); John F. Yanus, Webster, NY (US); Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 369 days.

This patent is subject to a terminal disclaimer.

(21) Appl. No.: 11/094,871

(22) Filed: Mar. 31, 2005

(65) Prior Publication Data

US 2006/0222978 A1 Oct. 5, 2006

(51) Int. Cl.
*G03G 5/14* (2006.01)

(52) U.S. Cl. ..... 430/60; 430/62; 430/63; 430/64; 430/96

(58) Field of Classification Search ..... 430/60, 430/62, 63, 64, 96
See application file for complete search history.

(56) References Cited

U.S. PATENT DOCUMENTS 3,121,006 A 2/1964 Middleton et al.
3,871,882 A 3/1975 Wiedemann
4,265,990 A 5/1981 Stolka et al.
4,587,189 A 5/1986 Hor et al.
5,314,776 A 5/1994 Numura et al.
5,473,064 A 12/1995 Mayo et al.
5,482,811 A 1/1996 Keoshkerian et al.
5,521,043 A 5/1996 Listigovers et al.
5,612,157 A 3/1997 Yuh et al.
5,789,127 A 8/1998 Yamaguchi et al.
6,015,645 A 1/2000 Murti et al.
6,287,737 B1 9/2001 Ong et al.
6,361,913 B1 3/2002 Pai et al.
6,479,202 B2 11/2002 Shida et al.
6,562,135 B2 * 5/2003 Bush et al. ..... 118/407
7,018,758 B2 * 3/2006 Tong et al. ..... 430/64
2004/0161683 A1 8/2004 Wu et al.
2004/0161684 A1 8/2004 Wu et al.

OTHER PUBLICATIONS

Jennifer Y. Hwang et al., U.S. Appl. No. 10/744,171 on Imaging Members, filed Dec. 23, 2003.

* cited by examiner

*Primary Examiner*—Hoa Van Le
(74) *Attorney, Agent, or Firm*—E. O. Palazzo

(57) ABSTRACT

An imaging member comprised of a hole blocking layer, a photogenerating layer, and a charge transport layer, and wherein the hole blocking layer is comprised of a metal alkyoxide, an amino siloxane, and at least one polymer binder containing epoxy groups.

27 Claims, 1 Drawing Sheet

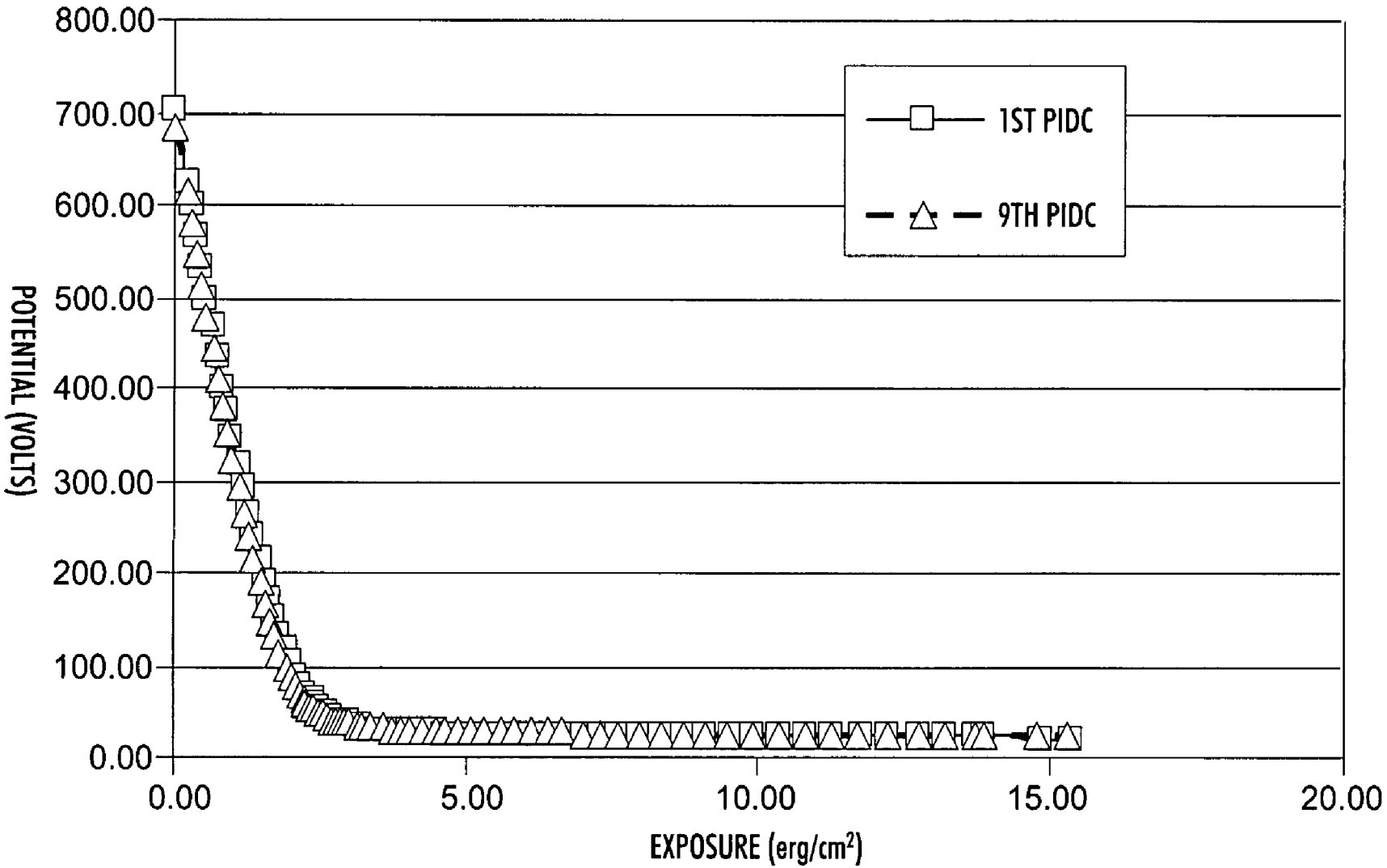
1ST PIDC
9TH PIDC
800.00
700.00
600.00
500.00
400.00
300.00
200.00
100.00
0.00
POTENTIAL (VOLTS)
0.00
5.00
10.00
15.00
20.00
EXPOSURE (erg/cm²)

PHOTOCONDUCTIVE IMAGING MEMBERS

CROSS REFERENCES

There is illustrated in copending U.S. application Ser. No. 10/369,816, now Publication No. 2004/0161684, entitled Photoconductive Imaging Members, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in copending U.S. application Ser. No. 10/744,171, entitled Imaging Members, the disclosure of which is totally incorporated herein by reference, an imaging member comprising an optional supporting substrate, an optional electrically conductive layer; a hole blocking layer; a charge generating layer; a charge transport layer; and an optional overcoat layer, wherein the hole blocking layer is formed from a composition comprising a binary binder and an n-type pigment, and wherein the binary binder comprises an isocyanate an a phenolic resin.

There is illustrated in copending U.S. application Ser. No. 10/370,186, now Publication No. 2004/0161683, entitled Photoconductive Imaging Members, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

In embodiments disclosed herein there may be selected the components of the above copending applications, including the substrates, In embodiments disclosed herein there may be selected the components of the above copending applications, including the substrates, photogenerating, charge transport, and other layers. More specifically, in embodiments there may be selected as the hole blocking layer the components as illustrated in U.S. application Ser. No.10/369,816, now Publication No. 2004/0161684.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

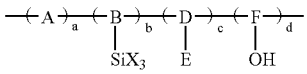

(I)

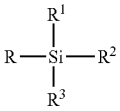

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, reference U.S. Pat. No. 4,587,189, the disclosure of which is totally incorporated herein by reference; and as a top layer a second charge transport layer.

The appropriate suitable components and processes of the above patents may be selected for the present disclosure in embodiments thereof.

An undercoat layer may be provided to mask substrate defects, to improve print quality (such as to reduce or eliminate imagewise constructive interference effects known as the "plywood effect"), to ensure environmental insensitivity, and/or to enable acceptable electrical properties, such as block holes, transport electrons, enable cyclic stability, provide low surface potential residue of photoinduced discharge (Vr) and dark decay (Vdd), and improve coating uniformity.

For electrophotographic imaging systems which utilize uniform negative charging prior to imagewise exposure, the undercoat charge blocking layer conducts negative charge arising from the generator layer while preventing positive charge leakage from the substrate. Further, undercoat layers that are too thin are usually more susceptible to pinholes which allow positive charges to leak through the charge blocking layer and result in print defects. Also, when charge blocking undercoat layers are too thin, small amounts of contaminants can adversely affect the performance of the charge blocking undercoat layer and cause print defects due to passage of positive charges through the layer. Defects in the hole blocking layer, which allow positive charges to leak through, lead to the development of charge deficient spots associated with copy printout defects.

Generally, undercoat layer formulations can be classified as dispersed undercoat layer solutions or homogeneous undercoat layer solutions. Dispersed undercoat layers comprise insoluble particles suspended in a binder. Homogenous undercoat layers comprise charge conductive species soluble in binders. A known method for preparing dispersed undercoat layer solutions comprises mixing metal oxides with polymeric binders in an organic solvent. The metal oxides may comprise, for example, titanium oxide, zinc oxide, zirconium oxide, tin oxide and aluminum oxide, and the polymeric resin binders selected include polyimides, polyamides, polyacrylates, vinyl polymers and other specialty materials. The aforementioned dispersion process can be very time consuming since the metal oxide particles in solution are nanometers in size, which is achieved through prolonged particle attrition, and where in the standing dispersed solution, the metal oxide tends to agglomerate, causing macro-phase separation which results in nonuniform coatings.

The process for preparing homogeneous undercoat layers comprises dissolving appropriate materials in the suitable solvents, and applying the solution to an electrically conductive substrate using suitable coating methods. As an example, a three-component undercoat layer is described in U.S. Pat. No. 5,789,127 to Yamaguchi and Sakaguchi entitled "Electrophotographic Photoreceptor" (Fuji-Xerox). The three-component undercoat layer described therein usually requires moisture during curing.

For most dispersed undercoat layer formulations, such as, for example, that described in U.S. Pat. No. 5,612,157 to Yuh and Chambers entitled "Charge Blocking Layer for Electrophotographic Imaging Member", the range of suitable materials may be somewhat limited. Many polymeric materials have the particle size, density, and dispersion stability in the proper range, but they have refractive index values that are too close to the binder resin used in the charge blocking layer. Light scattering particles having a refractive index similar to the binder refractive index may produce light scattering insufficient to eliminate the plywood effect in the resulting prints. Selecting inorganic particles, such as metal oxides, which typically have a higher refractive index than polymeric materials, to be the light scattering particles is problematic because inorganic particles, such as metal oxides, generally have higher densities than polymeric materials and thus can create a particle settling problem that adversely affects the uniformity of the blocking layer and the quality of the resulting prints.

BACKGROUND

This disclosure is generally directed to imaging members, and more specifically, the present disclosure is directed to single and multi-layered flexible, and rigid photoconductive imaging members with a hole blocking, or undercoat layer (UCL) comprised of, for example, a metal alkoxide, such as a conductive titanium alkoxide dispersed in a resin mixture of, for example, phenolic resin/phenolic resin blend or a phenolic resin/phenolic compound blend, and an epoxy resin binder or additive, and which layer can be deposited on a supporting substrate. More specifically, the present disclosure relates to layered photoconductive members containing an undercoat or blocking layer generated from a homogenous solution containing an epoxy resin, and wherein in embodiments the hole blocking layer is in contact with a supporting substrate, and which layer can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, perylenes, titanyl phthalocyanines, selenium, selenium alloys, azo pigments, squaraines, and the like. The imaging members of the present disclosure in embodiments exhibit excellent cyclic/environmental stability, and substantially no adverse changes in their performance over extended time periods since, for example, the imaging members comprise a mechanically robust and solvent resistant hole blocking layer, enabling the coating of a subsequent photogenerating layer thereon without structural damage; low and excellent $V_{low}$, that is the surface potential of the imaging member subsequent to a certain light exposure, and which $V_{low}$ is about 20 to about 100 volts lower than, for example, a comparable hole blocking layer of a titanium oxide/phenol resin/silicon oxide dopant, and which blocking layer can be easily coated on the supporting substrate by various coating techniques of, for example, dip or slot-coating. The photoresponsive, or photoconductive imaging members can be negatively charged when the photogenerating layers are situated between the hole transport layer and the hole blocking layer deposited on the substrate.

In embodiments there is disclosed a photoconductor that includes a first layer (also referred to herein as "undercoat layer") comprised of a polymer binder containing epoxy groups, and an ammonium titanate complex formed from the combination in the undercoat layer of a metal alkyl oxide and an amino siloxane. The present thick undercoat layer for xerographic photoreceptors can be coated at a thickness of, for example, up to about 25 microns. This permits rough substrates to be suitably coated and prevents or minimizes penetration of carbon fibers through the active layers to the substrate. The undercoat layer also provides improved hole blocking. Another important feature is the employment of the polymer binder containing epoxy groups, which polymer is crosslinkable with hydroxyl groups and/or amino groups upon heating, providing a robust undercoat layer. Exemplary polymers containing epoxy groups suitable for use include, but are not limited to, for example, EPON® 8111 (from Shell Chemicals Inc.), D.E.R® 330 and D.E.R® 663U (from Dow Plastics), and the like. When drying or coating, the epoxy resin will crosslink with amines and hydroxyl groups to form a robust undercoat layer, which will resist carbon fiber penetration and will be less sensitive to humidity.

Examples of epoxy resins which can be selected as the binder for the blocking or undercoat layer (UCL) include commercially available epoxy resins, such as the Epoxy resin EPON® 8111 as a cobinder with poly(vinyl butyral) wherein the EPON® can improve the interaction, especially the adhesion between the undercoat layer (UCL) and other layers present, such as the charge transport; and can also improve the coating quality of the UCL; cycle-up problems, and the like. Moreover, suitable further polymer, in addition to the epoxy resin, can be selected, which polymers are known, examples of which are provided herein.

Processes of imaging, especially xerographic imaging and printing, including digital, are also encompassed by the present disclosure. More specifically, the layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 500 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole. transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

One common type of photoreceptor is referred to as a multi-layered structure comprising an electrically conductive substrate, an undercoat layer formed on the substrate, a charge generating layer applied on the undercoat layer, and a charge transport layer formed on the charge generating layer. The phrases "charge blocking layer" and "blocking layer" are generally used interchangeably with the phrase "undercoat layer". U.S. Pat. No. 5,314,776 entitled "Multi-layered Photoreceptor for Electrophotography" illustrates a process for manufacturing a photoreceptor comprising a substrate which comprises an electroconductive support or a support having an electroconductive film formed thereon; an undercoat layer including a material selected from the group consisting of silicon dioxide and other silicon oxides formed on the substrate; a carrier generation layer formed on the undercoat layer; and a carrier transport layer formed on the charge generation layer.

U.S. Pat. No. 6,479,202 entitled "Electrophotographic Photoreceptor, Electrophotographic Image Forming Method, Electrophotograhic Image Forming Apparatus and Processing Cartridge" describes an electrophotographic photoreceptor having on a support a resin layer comprising a siloxane resin formed by hardening a compound represented by Formula 1, 2 or 3, or a hydrolyzed product which has a structural unit having a charge transportation ability.

U.S. Pat. No. 6,361,913 entitled "Long Life Photoreceptor" describes an electrophotographic imaging member comprising a substrate, a charge generating layer, a charge transport layer, and an overcoat layer comprising a hydroxytriphenyl methane having at least one hydroxy functional group, and a polyamide film forming binder capable of forming hydrogen bonds with the hydroxy functional group of the hydroxy triphenyl methane molecule, the charge transport layer being substantially free of triphenyl methane molecules.

In U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3 diiminoisoindolene (DI3) in an amount of from about 1 part to about 10 parts, and preferably about 4 parts DI3, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

There are also disclosed in U.S. Pat. No. 3,871,882, the disclosure of which is totally incorporated herein by reference, photoconductive substances comprised of specific perylene-3,4,9,10-tetracarboxylic acid derivative dyestuffs.

In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

Also, U.S. patents of interest are U.S. Pat. Nos. 5,789,127 and 5,612,157 (dispersed undercoat layers), (three component undercoat layer).

BRIEF DESCRIPTION OF THE DRAWINGS

FIG. 1 provides a graph showing PIDC characteristics of a photoreceptor prepared in accordance with an embodiment of the present disclosure as described in Example III.

SUMMARY

It is a feature of the present disclosure to provide imaging members with many of the advantages illustrated herein, such as acceptable anticarbon fiber characteristics, excellent electrical properties, minimal plywooding affects, a rapid curing of the hole blocking layer during device fabrication, for example, of about equal to, or less than about 30 minutes, for example from about 12 to about 20 minutes, and which layer prevents, or minimizes dark injection, and wherein the resulting photoconducting members possess, for example, excellent photoinduced discharge characteristics, cyclic and environmental stability and acceptable charge deficient spot levels arising from dark injection of charge carriers.

Another feature of the present disclosure relates to the provision of layered photoresponsive imaging members, which are responsive to near infrared radiation of from about 700 to about 900 nanometers.

It is yet another feature of the present disclosure to provide layered photoresponsive imaging members with sensitivity to visible light.

Moreover, another feature of the present disclosure relates to the provision of layered photoresponsive imaging members with mechanically robust and solvent resistant hole blocking layers containing a mixture of certain phenolic resin and epoxy resin binders.

In a further feature of the present disclosure there are provided imaging members containing hole blocking polymer layers comprised of epoxy resins, a metal alkoxide and suitable polymer like PVB as illustrated herein, or optionally phenolic compound/phenolic resin blend, or a low molecular weight phenolic resin/phenolic resin blend, and which phenolic compounds contained at least two, and more specifically, two to ten phenolic groups or low molecular weight phenolic resins with a weight average molecular weight ranging from about 500 to about 2,000, can interact with and consume formaldehyde and other phenolic precursors within the phenolic resin effectively, thereby chemically modifying the curing processes for such resins and permitting, for example, a hole blocking layer with excellent efficient electron transport, and which usually results in a desirable lower residual potential and $V_{low}$.

Moreover, in another feature of the present disclosure there is provided a hole blocking layer comprised of a metal alkoxide, a mixture of an epoxy resin binder, a phenolic resin/phenolic compound(s) blend or phenolic resin(s)/phenolic resin blend comprised of a first linear, or a first nonlinear phenolic resin and a second phenolic resin or phenolic compounds containing at least about 2, such as about 2, about 2 to about 12, about 2 to about 10, about 3 to about 8, about 4 to about 7, and the like, phenolic groups, and which blocking layer is applied to a drum of, for example, aluminum and cured at a high temperature of, for example, from about 135° C. to about 165° C., and wherein as one of the components of the UCL include phenolic compounds containing at least two, and more specifically, from about 2 to about 10, and yet more specifically, from about 4 to about 7 phenolic groups, such as bisphenol S, A, E, F, M, P, Z, hexafluorobisphenol A, resorcinol, hydroxyquinone, catechin, a lower molecular weight phenolic resin with a weight average molecular weight of from about 500 to about 2,000 blended with a phenolic resin containing phenolic groups, and wherein there results a cured mixture. The phenolic resins include formaldehyde polymers with phenol and/or cresol and/or p-tert-butylphenol and/or bisphenol A, such as VARCUM™ 29159 and 29112 (OxyChem Co.), DURITE™ P-97 (Borden Chemical), and AROFENE™ 986-Z1-50 (Ashland Chemical).

Aspects of the present disclosure relate to an imaging member comprised of a hole blocking layer, a photogenerating layer, and a charge transport layer, and wherein the hole blocking layer is comprised of a metal alkoxide, an amino siloxane, and at least one polymer binder containing epoxy groups; a photoconductive imaging member comprised of a hole blocking layer, a photogenerating layer, and a charge transport layer, and wherein the hole blocking layer is comprised of a metal alkoxide, an amino siloxane, and a polymer binder containing epoxy groups, and wherein said polymer is present in an amount of from about 0.1 to about 90 percent by weight based on the total weight of the blocking layer components; a xerographic device comprised of a charging component, an imaging component, a photoconductive component, a transfer component and a fusing component, and wherein the photoconductive component comprises a hole blocking layer, a photogenerating layer, and a charge transport layer, and wherein the hole blocking layer is comprised of a metal alkoxide, an amino siloxane, and a polymer binder containing epoxy groups; a photoconductive imaging member comprised of a supporting substrate, a hole blocking layer also referred to as an undercoat layer (UCL), or a charge blocking layer thereover, a photogenerating layer and a charge transport layer, and wherein the hole blocking layer is comprised of a metal oxide dispersed in a blend of an epoxy resin, a phenolic compound and a phenolic resin, or a blend of two phenolic resins wherein the first resin possesses a weight average molecular weight of from about 500 to about 2,000, and the second resin possesses a weight average molecular weight of from about 2,000 to about 20,000, and a dopant, for example, of silicon oxide present in an amount of, for example, from about 2 to about 15 weight percent; an imaging member comprising an electroconductive support containing an electroconductive layer thereon;

thereover a first layer comprising a metal alkoxide, an amino siloxane, and a polymer binder containing epoxy groups, and wherein the first layer is crosslinkable upon heating;

a charge generating layer and a charge transport layer; a process for preparing an imaging member comprising providing an electroconductive support having an electroconductive layer thereon;

forming thereover a first layer comprising a metal alkoxide, an amino siloxane, and a polymer binder containing epoxy groups; and forming thereover a charge generating layer and a charge transport layer; an imaging member that includes a first layer (also referred to herein as an "undercoat layer") of a suitable thickness, such as up to about 25 microns, thereby permitting, for example, the formation of a rough surface that can be easily coated and that prevents or minimizes the penetration of carbon fibers to the substrate, and which layer possesses hole blocking characteristics and contains a polymer binder containing epoxy groups; and moreover, wherein the polymer binder containing epoxy groups is crosslinkable with a component, such as an aminosilane containing hydroxyl groups and/or amino groups upon heating, providing a robust undercoat layer with an extended lifetime of at least about 1 to about 5 million imaging cycles; a photoconductive imaging member wherein the hole blocking layer is of a thickness of about 0.01 to about 30 microns, and more specifically, is of a thickness of about 0.1 to about 8 microns; a photoconductive imaging member comprised in sequence of a supporting substrate, a hole blocking layer, a photogenerating layer and a charge transport layer; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-bpolyvinyl pyridine, and polyvinyl formals; a photoconductive imaging member wherein the charge transport layer comprises aryl amine molecules; a photoconductive imaging member wherein the charge transport aryl amines are of the formula

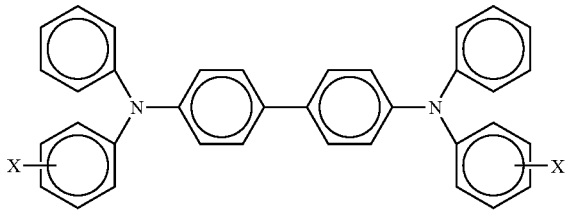

wherein X is selected from the group consisting of alkyl and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or a mixture thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; a photoconductive imaging member comprised of a supporting substrate, a hole blocking layer thereover, a photogenerating layer, and a charge transport layer, and wherein the hole blocking layer is generated from a titanium alkoxide dispersed in a blend of an epoxy resin optionally, and a suitable dissimilar resin, such as PVB; a photoconductive imaging member comprised of a hole blocking layer, a photogenerating layer, and a charge transport layer, and wherein the hole blocking layer binder is comprised of resins or polymers, one of which is an epoxy resin; an imaging member wherein the metal oxide is a titanium oxide; an imaging member wherein at least two is two, and wherein one of the phenolic resins possesses a lower weight average molecular weight than the second phenolic resin, and wherein lower is from about 1,000 to about 10,000; an imaging member wherein the weight average molecular weight of the low molecular weight phenolic resin is from about 500 to about 2,000; an imaging member wherein the phenolic compound is bisphenol S, 4,4'-sulfonyldiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl)methane; an imaging member wherein the phenolic compound is bisphenol M, 4,4'-(1,3-phenylenediisopropylidene) bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member wherein the phenolic compound is hydroxyquinone, 1,4-benzenediol; an imaging member wherein the phenolic compound is of the formula

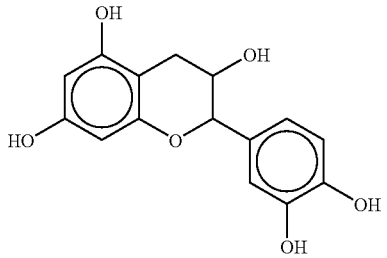

Catechin an imaging member wherein the phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; and a formaldehyde polymer generated with phenol and p-tert-butylphenol; an imaging member wherein there is selected for the blocking layer about 4 to about 50 weight percent of a phenolic compound; an imaging member wherein the blocking layer comprises from about 1 to about 99 weight percent of each of two resins; an imaging member wherein the hole blocking layer is of a thickness of about 0.01 to about 30 microns; an imaging member wherein the hole blocking layer is of a thickness of from about 0.1 to about 8 microns; an imaging member comprised in the sequence of a supporting substrate, a hole blocking layer, an optional adhesive layer, a photogenerating layer, and a hole transport layer; an imaging member wherein the adhesive layer is comprised of a polyester with an $M_w$ of about 45,000 to about 75,000, and an $M_n$ of from about 30,000 to about 40,000; an imaging member further containing a supporting substrate comprised of a conductive metal substrate of aluminum, aluminized polyethylene terephthalate or titanized polyethylene terephthalate; an imaging member wherein the photogenerator layer is of a thickness of from about 0.05 to about 10 microns, and wherein the transport layer is of a thickness of from about 10 to about 50 microns; an imaging member wherein the photogenerating layer is comprised of photogenerating pigments dispersed in a resinous binder in an amount of from about 5 percent by weight to about 95 percent by weight, and optionally wherein the resinous binder is selected from the group comprised of vinyl chloride/vinyl acetate copolymers, polyesters, polyvinyl butyrals, polycarbonates, polystyrene-bpolyvinyl pyridine, and polyvinyl formals; an imaging member wherein the charge transport layer comprises suitable known or future developed components, and more specifically aryl amines, and which aryl amines are of the formula

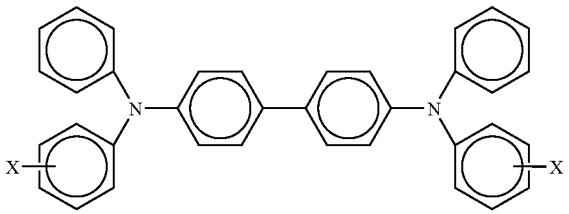

wherein X is selected from the group consisting of alkyl, alkoxy, and halogen, and the like, and wherein the aryl amine is optionally dispersed in a resinous binder; an imaging member wherein alkyl contains from about 1 to about 10 carbon atoms; an imaging member wherein the aryl amine is N,N'-diphenyl-N,N-bis(3-methyl phenyl)-1,1'-biphenyl-4,4'-diamine; an imaging member wherein the photogenerating layer is comprised of metal phthalocyanines, or metal free phthalocyanines; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; a method of imaging which comprises generating an electrostatic latent image on the imaging member illustrated herein, developing the latent image with a known toner, and transferring the developed electrostatic image to a suitable substrate like paper; a photoconductive imaging member comprised of a supporting substrate, a hole blocking layer, a photogenerating layer, and a charge transport layer, and wherein the hole blocking layer is comprised of a mixture of a metal oxide, an epoxy resin binder, a phenolic compound containing two phenolic groups, a phenolic resin and a dopant; a rigid photoconductive imaging member wherein the phenolic compound is bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylenediisopropylidene) bisphenol), S (4,4'-sulfonyidiphenol), Z (4,4'-cyclohexylidenebisphenol), hexafluorobisphenol A (4,4'-(hexafluoroisopropylidene) diphenol), resorcinol, hydroxyquinone or catechin, and wherein the blocking layer is provided on an aluminum drum followed by heat curing at a temperature of, for example, from about 135° C. to about 185° C.; a photoconductive imaging member wherein the phenolic resin is comprised of a first resin that possesses a weight average molecular weight of from about 500 to about 2,500, and a second resin that possesses a weight average molecular weight of from about 3,500 to about 20,000, and wherein the blocking layer is provided on an aluminum drum followed by heat curing at a temperature of from about 135° C. to about 190° C.; an imaging member wherein the phenolic compound contains from about 2 to about 10 phenolic groups, or optionally a blend of two phenolic resins with dissimilar molecular weights; an imaging member wherein at least two is from about 2 to about 10; an imaging member wherein at least two is from about 2 to about 7; and an imaging member wherein at least two is two, and wherein the first phenolic resin has a weight average molecular weight of from about 3,000 to about 17,000, and the second phenolic resin has a weight average molecular weight of from about 700 to about 1,500; and an imaging member wherein the binder resins possess a weight average molecular weight of from about 500 to about 40,000.

Examples of metal alkoxides wherein alkyl can contain, for example, from 1 to about 25, and more specifically, from 1 to about 10 carbon atoms, suitable for use in the undercoat layer include, but are not limited to, metal methoxides, metal ethoxides, metal propoxides, metal isopropoxides, metal butoxides, titanium propoxide, titanium isopropoxide, titanium methoxide, titanium butoxide, titanium ethoxide, zirconium isopropoxide, zirconium propoxide, zirconium butoxide, zirconium ethoxide, zirconium methoxide, or combinations thereof.

The amino siloxane may comprise, for example, an amino siloxane such as an amino alkylalkoxysilane, including, but not limited to, 3-aminopropyltrimethoxysilane (APS), 3-aminopropyltriethoxysilane, 3-aminopropyl diisopropylethoxysilane, 3-aminophenyltrimethoxysilane, 3-aminopropylmethyl diethoxysilane or 3-aminopropylpentamethyldisiloxane, and the like.

The binder may contain a polymer with more than two epoxy groups which are crosslinkable with hydroxyl groups and/or amino groups upon heating. Exemplary polymers containing epoxy groups suitable for use include, but are not limited to, for example, EPON® 8111 (from Shell Chemicals Inc.), D.E.R® 330 and D.E.R® 663U (from Dow Plastics), and the like. The polymer containing epoxy groups are present in the undercoat layer in an amount of, for example, from about 0 to about 90 percent, and more specifically, from about 1 percent to about 60 percent, weight basis, based upon the total weight of the undercoat layer.

The undercoat layer component can be dispersed in a polymer binder, such as a mixture of an epoxy resin, and a suitable polymer like polymethylmethacrylate (PMMA), polyvinyl butyral (PVB), polyvinyl alcohol, poly(hydroxyethyl methacrylate), poly(hydroxypropyl acrylate) or poly (vinylpyrrolidone); a copolymer, such as a vinyl halide, especially a vinyl chloride copolymer, such as poly(vinyl chloride-co-vinyl acetate), poly(vinyl chloride-co-vinyl acetate-co-vinyl alcohol), poly(vinylidene chloride-co-methyl acrylate) or poly(vinyl chloride-co-isobutyl vinyl ether), and the like. The solvent selected for the coating solution can be any suitable organic solvent, such as, for example, methyl ethyl ketone (MEK), tetrahydrofuran (THF), toluene, an alcohol, such as, for example, 1-propanol, 2-propanol, methanol, ethanol, 1-butanol, and acetone, among other solvents.

The binder polymer, such as PVB, is present in an amount of from about 1 percent to about 99 percent, more specifically from about 5 percent to about 70 percent based upon the total weight of the undercoat layer.

The coating solvent is provided in an amount suitable to control the viscosity of the coating solution, with total solution solvent concentrations typically being from about 5 percent to about 95 percent, and more specifically, from about 15 percent to about 80 percent based upon the total weight of the undercoat layer.

The metal alkoxide, such as titanium isopropoxide, is present in the undercoat layer in an amount such as from about 5 percent to about 95 percent, more specifically from about 20 percent to about 80 percent based upon the total weight of the undercoat layer.

The amino siloxane, such as 3-aminopropyltrimethoxysilane, is present in an amount of from about 95 percent to about 5 percent, and more specifically, from about 80 percent to about 20 percent based upon the total weight of the undercoat layer.

Illustrative examples of substrate layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over about 3,000 microns, or of minimum thickness providing there are no significant adverse effects on the member. In embodiments, the thickness of this layer is from about 50 to about 400, or from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogennerating layer can contain known photogenerating pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer, more specifically, includes amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments, such as the X-form of metal free phthalocyanine, metal phthalocyanines, such as vanadyl phthalocyanine and copper phthalocyanine, quinacridones, dibromo anthanthrone pigments, benzimidazole perylene, substituted 2,4-diamino-triazines, polynuclear aromatic quinones, and the like, dispersed in a film forming polymeric binder. Selenium, selenium alloy, enzimidazole perylene, and the like, and mixtures thereof, may be formed as a continuous, homogeneous photogenerating layer. Benzimidazole perylene compositions are well known and described, for example, in U.S. Pat. No. 4,587,189 entitled "Photoconducting Imaging Members With Perylene Pigment Compositions", the disclosure of which is totally incorporated herein by reference. Multi-photogenerating layer compositions may be utilized where a photoconductive layer enhances or reduces the properties of the photogenerating layer. Other suitable photogenerating materials known in the art may also be utilized, if desired.

Any suitable charge generating binder layer comprising photoconductive particles dispersed in a film forming binder may be utilized. Photoconductive particles for the charge generating binder layer, such as vanadyl phthalocyanine, metal-free phthalocyanine, benzimidazole perylene, amorphous selenium, trigonal selenium, selenium alloys, such as selenium-tellurium, selenium-tellurium-arsenic, selenium arsenide, and the like, and mixtures thereof, are especially preferred because of their sensitivity to white light. Vanadyl phthalocyanine, metal free phthalocyanine and tellurium alloys are also preferred because these materials provide the additional benefit of being sensitive to infrared light. The photogenerating materials selected should be sensitive to activating radiation having a wavelength between about 600 nanometers, and about 700 nanometers during the imagewise radiation exposure step in an electrophotographic imaging process to form an electrostatic latent image.

Any suitable resin material including those soluble, for example, in methylene chloride, chlorobenzene or other suitable solvents may be selected for the photogeneration layer binders including those described, for example, in U.S. Pat. No. 3,121,006, the disclosure of which is totally incorporated herein by reference. Typical organic resinous binders include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like, and wherein the photogenerating component is present, for example, in an amount of about 5 to about 100, and more specifically, from about 325 to about 60 weight percent.

The photogenerating composition or pigment can be present in the resinous binder composition in various amounts as indicated herein. Generally, from about 5 percent to about 90 percent by volume of the photogenerating pigment is dispersed in about 10 percent to about 95 percent by volume of the resinous binder, and more specifically, from about 20 percent to about 30 percent by volume of the photogenerating pigment is dispersed in about 70 percent to about 80 percent by volume of the resinous binder composition.

The photogenerating layer containing photoconductive compositions and/or pigments and the resinous binder material generally are provided in a thickness of from about 0.1 micrometer to about 5 micrometers, and preferably have a thickness of from about 0.3 micrometer to about 3 micrometers. The thickness of the photogenerating layer is related to binder content, with higher binder content compositions generally requiring thicker layers for photogeneration. A thickness outside of these ranges can be selected providing the objectives of the present invention are achieved.

The coating of the photogenerator layers in embodiments of the present disclosure can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

Aryl amines selected for the charge, especially hole transporting layers, which generally are of a thickness of from about 5 microns to about 75 microns, and more specifically, of a thickness of from about 10 microns to about 40 microns, include molecules of the following formula

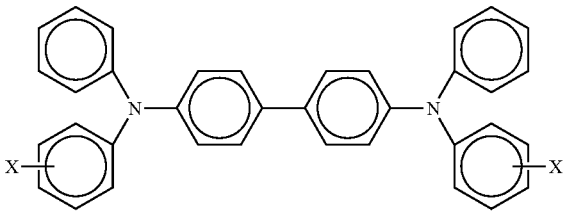

dispersed in a highly insulating and transparent polymer binder, wherein X is an alkyl group, a halogen, or mixtures thereof, especially those substituents selected from the group consisting of Cl and $CH_3$. Other known hole transport components can be selected in place of the aryl amines.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

In embodiments, materials suitable for use as charge transport layers include, but are not limited to, any suitable transparent organic polymer or nonpolymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack, and therefore extends the operating life of the photoreceptor imaging member. The charge transport layer should exhibit negligible, if any, discharge when exposed to a wavelength of light useful in xerography, e.g. 4,000 angstroms to 9,000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer.

The active transport layer is normally transparent when exposure is effected through the active layer to ensure that most of the incident radiation is utilized by the underlying charge carrier generator layer for efficient photogeneration. The charge transport layer in conjunction with the charge generation layer in the instant invention is a material which is an insulator to the extent that an electrostatic charge placed on the transport layer is not conducted in the absence of illumination.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multi-layer imaging member of this disclosure comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups, such as $NO_2$ groups, CN groups, and the like. Typical aromatic amine compounds include, for example, triphenylmethane, bis(4-diethylamine-2-methylphenyl) phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like, dispersed in an inactive resin binder.

Examples of electrophotographic imaging members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures of which are totally incorporated herein by reference.

The metal alkoxide and the amino siloxane form an ammonium titanate complex. Ammonium titanate is a stable, conductive hybrid organic-inorganic complex with good solubility in aliphatic alcohols. Also, titanium isopropoxide and 3-aminopropylsilane are both moisture sensitive compounds, titanium isopropoxide and 3-aminopropylsilane react to form an ammonium titanate complex at room temperature.

The undercoat layer solution can be coated at a thickness of up to about 20 micrometers on a photoreceptor support, such as an aluminum drum substrate, through, for example, Tsukiage-dip coating. If desired, the undercoat layer can be thin, such as about 0.1 micron to a thickness, as stated above, or thick, such as up to about 20 microns. The undercoat layer may also be applied by any suitable technique such as spraying, dip coating, draw bar coating, gravure coating, silk screening, air knife coating, reverse roll coating, vacuum deposition, chemical treatment, and the like.

Examples of the binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are provided.

EXAMPLE I

Four (4) grams of titanium isopropoxide, 98+ percent, (Fisher Scientific) were added directly into a brown bottle containing 4 grams of 3-aminopropyltrimethoxysilane, 97 percent, (Fisher Scientific) with slight stirring. The exothermic reaction occurred instantly to give a clear solution. The reaction was stoichiometric generating an ammonium titanate complex. This solution was allowed to cool naturally until it reached room ambient temperature, about 24° C. The cooled solution was added into a polymer solution containing 1.5 grams of polyvinyl butyral (Sekisui-Specialty Chemicals Company) and 0.5 gram of epoxy resin EPON® 8111 in 20 grams of a 1-propanol solvent. The mixture was stirred slightly on a roll mill (U.S. Stoneware, Akron, Ohio) for about 15 hours to obtain a clear solution indicating that the solution was ready to be coated as an undercoat layer. The solution appeared very stable with no obvious visual viscosity changes after the solution remained at room temperature, about 23° C. to about 25° C., for about one month.

EXAMPLE II

The prepared undercoat layer solution of Example I was coated onto a 30 millimeter in diameter aluminum drum substrate to a thickness of about 5 microns by the Tsukiage dip coating method at 350 millimeters/minute pull-rate. The coated undercoat layer was dried in a forced air oven at about 160° C. for about 30 minutes. After drying, a charge generating layer and a charge transport layer were coated sequentially onto the undercoat layer by dip coating. The charge generating layer solution comprised 2.5 weight percent of hydroxy-gallium phthalocyanine Type V (Xerox Corporation) and 2.5 weight percent of poly(vinyl chloride) copolymer with molecular weight $M_w$=40,000 (VMCH from Dow Chemicals) in 95 weight percent of n-butyl acetate, and was coated at a thickness of about 0.3 micron. The charge transport layer solution comprised 8 weight percent of N,N'-diphenyl-N,N'-bis(3-methylphenyl)-1,1'-biphenyl-4,4'-diamine, 12 weight percent of poly(4,4'-diphenyl-1,1'-cyclohexane carbonate (Mitsubishi Chemicals) in 80 weight percent of tetrahydrofuran, and was coated to a thickness of about 25 microns.

EXAMPLE III

The electrical properties of the prepared photoreceptor device with the present undercoat layer (Example I) were tested in accordance with standard drum photoreceptor test methods. The electrical properties of the photoreceptor sample prepared according to Example II were evaluated with a xerographic testing scanner. The drums were rotated at a constant surface speed of 15.7 centimeters per second. A direct current wire scorotron, narrow wavelength band exposure light, erase light, and four electrometer probes were mounted around the periphery of the mounted photoreceptor samples. The sample charging time was 177 milliseconds. The exposure light had an output wavelength of 680 nanometers, and the erase light had an output wavelength of 550 nanometers.

The test samples were first retained in the dark for at least 60 minutes to ensure achievement of equilibrium with the testing conditions at 50 percent relative humidity and 72° F. Each sample was then negatively charged in the dark to a potential of about 700 volts. The test procedure was repeated to determine the photoinduced discharge characteristic (PIDC) of each sample by different light energies of up to 40 ergs/cm$^2$. This kind of charging-discharging was continuously repeated for 5,000 cycles. A total of 9 PIDC curves were recorded with equal interval cycle numbers, see FIG. 1.

FIG. 1 provides a graph showing PIDC characteristics of a photoreceptor prepared in accordance with an embodiment of the present disclosure as described in the above Example. The PIDC in FIG. 1 illustrate a very stable and excellent photoinduced discharge performance. Other electrical properties of the prepared photoconductors are shown in Table 1.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An imaging member comprised of a hole blocking layer, a photogenerating layer, and a charge transport layer, and wherein the hole blocking layer is comprised of a metal alkoxide, an amino siloxane, and at least one polymer binder containing epoxy groups.

2. A photoconductive imaging member comprised of a hole blocking layer, a photogenerating layer, and a charge transport layer, and wherein the hole blocking layer is comprised of a metal alkoxide, an amino siloxane, and a polymer binder containing epoxy groups, and wherein said polymer is present in an amount of from about 0.1 to about 90 percent by weight based on the total weight of the blocking layer components.

3. An imaging member in accordance with claim 1 wherein the metal alkoxide is selected from the group consisting of metal methoxides, metal ethoxides, metal propoxides, metal isopropoxides, and metal butoxides.

4. An imaging member in accordance with claim 1 wherein said siloxane is an amino alkylalkoxysilane selected from the group comprised of 3-aminopropyltrimethoxysilane, 3-aminopropyltriethoxysilane, 3-aminopropyl diisopropylethoxysilane, 3-aminophenyltrimethoxysilane, 3-aminopropylmethyl diethoxysilane, and 3-aminopropylpentamethyl disiloxane.

5. An imaging member in accordance with claim 1 wherein the polymer binder contains at least two epoxy groups in the molecular chains.

6. An imaging member in accordance with claim 1 wherein the hole blocking layer is of a thickness of about 0.1 micron to about 20 microns.

7. An imaging member in accordance with claim 1 further containing a supporting substrate optionally comprised of a metal or metal alloy.

8. An imaging member in accordance with claim 1 wherein the photogenerating layer comprises a component selected from at least one of the group comprised of amorphous selenium, trigonal selenium, selenium alloys, metal phthalocyanines, vanadyl phthalocyanine, quinacridones, dibromo anthanthrone pigments, benzimidazole perylene, substituted 2,4-diamino-triazines, polynuclear aromatic quinones, enzimidazole perylene; and wherein said member

TABLE 1

| | V (0) (volt) | V (2.8) (volt) | V (4.26) (volt) | V (13) (volt) | Dv/dx (volt * cm$^2$/erg) | Verase (volt) | Dark Decacy (volt) | Q/A PIDC (nC/cm$^2$) |
|---|---|---|---|---|---|---|---|---|
| The First PIDC | 695 | 25 | 19 | 16 | −391 | 12 | 11 | 80 |
| The Ninth DIPC | 696 | 23 | 18 | 16 | 416 | 13 | 13 | 86 |

With reference to the abbreviations employed in Table 1:
V(0) (PIDC) is the dark voltage after scorotron charging
Q/A PIDC is the current density to charge the devices to the V(0) values
Dark Decay is 0.2 s Duration Decay voltage
V (2.6) is average voltage after exposure to 2.6 erg/cm$^2$
V (4.26) is average voltage after exposure to 4.26 erg/cm$^2$
V (13) is average voltage after exposure to 13 erg/cm$^2$
dV/dX is the initial slope of the PIDC
Verase is average voltage after erase exposure.

further comprises a supporting substrate of aluminum, zirconium, niobium, tantalum, vanadium, hafnium, titanium, nickel, stainless steel, chromium, tungsten, molybdenum, or mixtures thereof.

9. An imaging member in accordance with claim 1 wherein the charge transport layer comprises a material selected from the group consisting of triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine, N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and mixtures thereof; and optionally wherein said photogenerating layer is selenium tellurium, selenium tellurium arsenic, selenium arsenide, or the X-form of a metal free phthalocyanine.

10. An imaging member in accordance with claim 1 wherein the metal alkoxide is present in an amount of from about 5 percent to about 95 percent, or from about 20 percent to about 80 percent, based upon the total weight of the hole blocking layer components.

11. An imaging member in accordance with claim 1 wherein the amino siloxane is present in an amount of from about 95 percent to about 5 percent, or from about 80 percent to about 20 percent.

12. An imaging member in accordance with claim 1 wherein the polymer containing epoxy groups is present in an amount of from about 1 to about 90 percent.

13. An imaging member in accordance with claim 1 wherein said hole blocking layer is of a thickness of about 0.01 to about 30 microns.

14. An imaging member in accordance with claim 1 wherein said hole blocking layer is of a thickness of from about 0.1 to about 5 microns.

15. An imaging member in accordance with claim 1 comprised in the following sequence of a supporting substrate, said hole blocking layer, an adhesive layer, said photogenerating layer, and said charge transport layer, and wherein the charge transport layer is a hole transport layer.

16. An imaging member in accordance with claim 15 wherein the adhesive layer is present and is comprised of a polyester optionally with an $M_w$ of about 45,000 to about 75,000, and an $M_n$ of from about 30,000 about 40,000.

17. An imaging member in accordance with claim 15 wherein the supporting substrate is comprised of a conductive metal of aluminum, aluminized polyethylene terephthalate, or titanized polyethylene terephthalate.

18. An imaging member in accordance with claim 15 wherein said photogenerator layer is of a thickness of from about 0.05 to about 10 microns, and wherein said transport layer is of a thickness of from about 20 to about 50 microns.

19. An imaging member in accordance with claim 1 wherein the photogenerating layer is comprised of a photogenerating pigment or photogenerating pigments dispersed in a resinous binder, and wherein said pigment or pigments are present in an amount of from about 5 percent by weight to about 95 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals.

20. An imaging member in accordance with claim 1 wherein the charge transport layer comprises aryl amines, and which aryl amines are of the formula

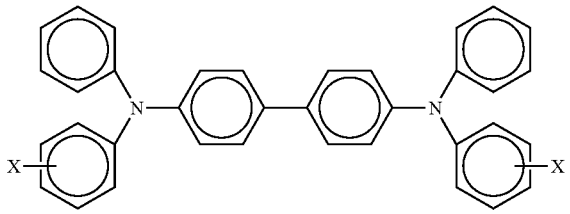

wherein X is selected from the group consisting of alkyl, alkoxy and halogen.

21. An imaging member in accordance with claim 20 wherein the aryl amine is N,N'-diphenyl-N,N-bis(3-methyl phenyl)-1,1'-biphenyl-4,4'-diamine, and wherein the photogenerating layer is comprised of metal phthalocyanines, or metal free phthalocyanines.

22. An imaging member in accordance with claim 1 wherein the photogenerating layer is comprised of titanyl phthalocyanines, perylenes, or hydroxygallium phthalocyanines.

23. An imaging member in accordance with claim 1 wherein the photogenerating layer is comprised of Type V hydroxygallium phthalocyanine.

24. A xerographic device comprised of a charging component, an imaging component, a photoconductive component, a transfer component and a fusing component, and wherein the photoconductive component comprises a hole blocking layer, a photogenerating layer, and a charge transport layer, and wherein the hole blocking layer is comprised of a metal alkoxide, an amino siloxane, and a polymer binder containing epoxy groups.

25. An imaging member in accordance with claim 1 wherein said metal alkoxide is selected from the group comprised of titanium propoxide, titanium isopropoxide, titanium methoxide, titanium butoxide, titanium ethoxide, zirconium isopropoxide, zirconium propoxide, zirconium butoxide, zirconium ethoxide, zirconium methoxide, and mixtures thereof.

26. An imaging member in accordance with claim 1 wherein at least one is from about 2 to about 5.

27. A photoconductor comprised of a hole blocking layer, which blocking layer is comprised of an aminopropyltrimethoxy silane, titanium isopropoxide, a polymer binder containing at least two epoxy groups in the molecular chains, a photogenerating layer comprised of hydroxygallium phthalocyanine Type V, a charge transport layer comprised of N,N'-diphenyl-N,N'-bis(3-methylphenyl)-1,1'-biphenyl-4,4'-diamine, and a polycarbonate binder; and which member further includes a supporting substrate comprised of aluminum, and which substrate is in contact with the hole blocking layers.

* * * * *